US008523383B1

(12) United States Patent
Grigore et al.

(10) Patent No.: US 8,523,383 B1
(45) Date of Patent: Sep. 3, 2013

(54) RETROFITTING RECESSED LIGHTING FIXTURES

(75) Inventors: Valerica Grigore, Longmont, CO (US); Dean Grierson, Westminster, CO (US)

(73) Assignee: Cooper Technologies Company, Houston, TX (US)

( * ) Notice: Subject to any disclaimer, the term of this patent is extended or adjusted under 35 U.S.C. 154(b) by 204 days.

(21) Appl. No.: 13/031,448

(22) Filed: Feb. 21, 2011

Related U.S. Application Data

(60) Provisional application No. 61/306,010, filed on Feb. 19, 2010.

(51) Int. Cl.

| | |
|---|---|
| ***F21S 4/00*** | (2006.01) |
| ***F21V 19/02*** | (2006.01) |
| ***F21V 21/00*** | (2006.01) |
| ***H01R 33/00*** | (2006.01) |

(52) U.S. Cl.
USPC .. 362/221; 362/630; 362/217.13; 362/217.17

(58) Field of Classification Search
USPC ..... 362/221, 630, 217.13, 217.17
See application file for complete search history.

(56) References Cited

U.S. PATENT DOCUMENTS

| | | | | |
|---|---|---|---|---|
| 4,562,517 | A * | 12/1985 | Pankin | 362/147 |
| 5,580,158 | A * | 12/1996 | Aubrey et al. | 362/640 |
| 5,823,663 | A * | 10/1998 | Bell et al. | 362/362 |
| 6,092,913 | A * | 7/2000 | Edwards, Jr. | 362/260 |
| 6,102,550 | A * | 8/2000 | Edwards, Jr. | 362/221 |
| 6,257,735 | B1 * | 7/2001 | Baar | 362/260 |
| 6,739,734 | B1 * | 5/2004 | Hulgan | 362/243 |
| 6,908,212 | B2 * | 6/2005 | Schultz | 362/220 |
| 7,229,192 | B2 | 6/2007 | Mayfield et al. | |
| 7,261,435 | B2 | 8/2007 | Gould et al. | |
| 8,220,957 | B2 * | 7/2012 | Lydecker et al. | 362/222 |
| 2006/0023450 | A1 * | 2/2006 | Chung et al. | 362/246 |
| 2007/0211457 | A1 * | 9/2007 | Mayfield et al. | 362/223 |
| 2008/0285266 | A1 * | 11/2008 | Thomas | 362/218 |
| 2009/0207603 | A1 | 8/2009 | Lydecker et al. | |
| 2010/0091484 | A1 | 4/2010 | Mayfield et al. | |

OTHER PUBLICATIONS

A.L.P. Lighting Components, Inc.; Guide to Lighting Retrofit; 2008.
Lithonia Lighting; Relight Sales Manual; Installation Instructions: RT5R; Mar. 17, 2008.
Energy Solutions International, Inc.; Retrofit Series; 2009.

* cited by examiner

*Primary Examiner* — David J Makiya
(74) *Attorney, Agent, or Firm* — King & Spalding LLP

(57) ABSTRACT

A retrofit kit assembly for a recessed lighting fixture and methods for manufacturing and installing the same are described herein. The retrofit kit includes at least two mounting brackets, which can each include at least one lamp socket. The kit also includes at least one ballast, which may be pre-wired to the sockets. Each ballast may include a temporary adhesive on a mounting side thereof, for use during the installation process. For example, the installer may provisionally mount the ballast to an interior surface of an existing housing of the fixture and then permanently mount the ballast using one or more fasteners. The mounting brackets and ballast of the kit may include captive hardware which is held in place in the aperture for the fastener prior to fastening the particular object to the recessed housing, which reduces risk of dropping or losing fasteners during installation.

20 Claims, 16 Drawing Sheets

RETROFITTING RECESSED LIGHTING FIXTURES

RELATED APPLICATION

This application claims priority under 35 U.S.C. §119 to U.S. Provisional Patent Application No. 61/306,010, titled "Systems, Methods, and Devices for Retrofitting Recessed Fluorescent Lighting Fixtures," filed on Feb. 19, 2010, the complete disclosure of which is hereby fully incorporated herein by reference.

TECHNICAL FIELD

This disclosure relates generally to lighting fixtures and, more particularly, to retrofitting recessed lighting fixtures.

BACKGROUND

Recent technologies relative to ballasts and light sources are more energy efficient than those used in the past. However, the expense of replacing an entire light fixture previously installed may make taking advantage of such improvements in these technologies cost prohibitive. Recently, efforts have been made to retrofit previously installed light fixtures to provide a less expensive way to take advantage of new lighting technology.

Light fixture retrofitting is the practice of replacing or eliminating components in an existing light fixture housing to make the light fixture more energy efficient or change some other performance characteristic of the light fixture. However, the larger the cost of replacement components and longer the installation of a retrofit solution takes, the less likely that retrofit solution will make economic sense for the owner of the previously installed light fixture.

Many current retrofitting solutions are relatively crude in design, often requiring lengthy and complex installation with loose parts, which may add to the installer's difficulty since many of the light fixtures being retrofitted are recessed in a ceiling. Wiring the previously installed fixture is often a difficult task and, sometimes, a hazardous one that could affect the safety of the installer, especially when the fixtures are at high elevation or difficult to reach. Essentially, the pre-existing housing is an upside down box where any installation of a new component into that upside down box brings with it the risk of falling objects. This creates a safety hazard not only for the installer but other individuals in the installation area. Moreover, the more cumbersome the installation, the longer the installation may take and the greater the number of installers needed to complete the installations. Such delay and/or additional installers only add to the expense of retrofitting existing lighting fixtures.

SUMMARY

A kit may be provided for retrofitting a preexisting recessed light fixture housing mounted in a ceiling plane. The preexisting recessed light fixture housing can include an upper base panel and opposed end walls extending generally downward from the upper base panel. The kit can include first and second mounting brackets that are coupled to the housing, adjacent the opposed end walls. Each mounting bracket can include an electrical socket. The electrical sockets can complete a circuit with a lamp, such as a fluorescent lamp, a linear LED lamp, and/or another lamp, when the lamp is installed between the electrical sockets.

The kit also can include a ballast that provides power to the circuit when the kit is installed in the recessed light fixture. The ballast can be configured to be coupled to the upper base panel of the housing. An adhesive can be disposed on a mounting side of the ballast, for provisionally mounting the ballast to the upper base panel of the housing prior to installation of a fastener, which permanently mounts the ballast to the upper base panel of the housing. The fastener may include a captive hardware element, which is pre-installed in the ballast and designed to be movable relative to the ballast only upon application of deliberate force with respect to the captive hardware element. Each mounting bracket also may include one or more captive hardware elements.

These and other aspects, features and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the claimed invention and the advantages thereof, reference is now made to the following description, in conjunction with the accompanying figures briefly described as follows.

FIG. 12, including

FIG. 14, including

FIG. 19, including FIGS. 19A-191, depicts a method for retrofitting a recessed light fixture, in accordance with certain exemplary embodiments.

DETAILED DESCRIPTION OF EXEMPLARY EMBODIMENTS

Figure 1:
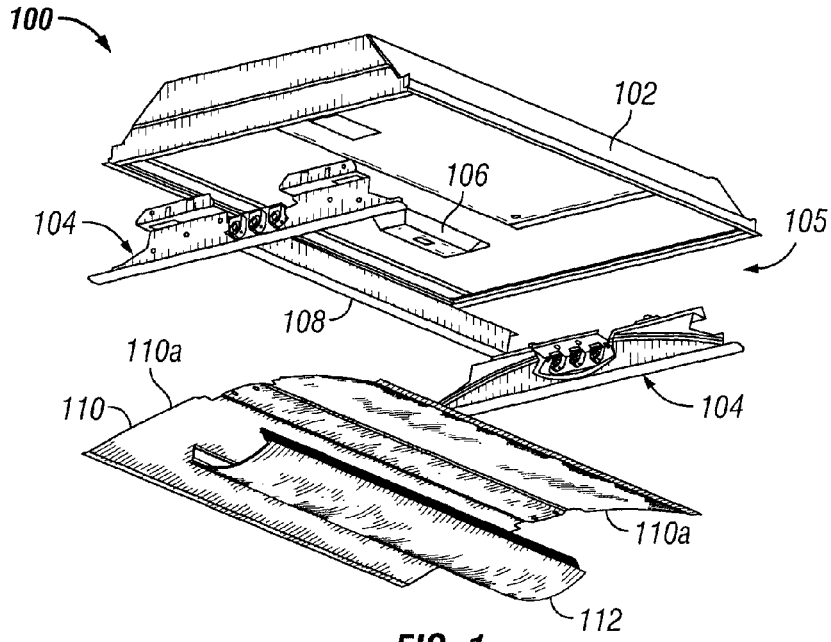
FIG. 1 is an exploded view of a top-level assembly of a retrofit linear lighting fixture, in accordance with certain exemplary embodiments.

Embodiments of the claimed invention are directed to improved retrofit solutions for recessed light fixtures. In certain exemplary embodiments, a kit for retrofitting an existing light fixture includes mounting brackets, which each include at least one lamp socket, as well as a ballast, which is pre-wired to the sockets. Pre-wiring these components reduces time and expertise required for installation. Each ballast may include an adhesive on a mounting side thereof, for use during the installation process. For example, the installer may provisionally mount the ballast to an interior surface of an existing housing of the fixture using the adhesive and then permanently mount the ballast using one or more fasteners. The fasteners of the kit may include captive hardware, which reduces risk of dropping or losing parts of the kit during installation.

In certain exemplary embodiments, the kit includes a reduced total number of parts as compared to previous retrofit solutions. For example, certain exemplary embodiments eliminate the need for an inner reflector by creating a single reflector design that serves as the luminaire reflector while also serving as a ballast and/or splice cover, thereby simplifying installation and reducing overall costs. In addition, the mounting brackets of the kit may include various different possible socket locations, thereby providing flexibility with regard to the number and positioning of the lamps while eliminating the need for an additional socket bracket. The kit may be adapted to work with one, two, or three different lamps, which may be T5 lamps, for example.

Although described herein in connection with fluorescent light fixtures, a person of ordinary skill in the art will recognize that the retrofit solutions described herein may be used with other types of light sources, such as linear light emitting diode ("LED") light sources. For example, instead of including or using a ballast, the retrofit solution can include or use a driver, which controls and/or powers linear LED light sources. Thus, the description herein of lamps and ballast should be understood to include both fluorescent and non-fluorescent lamps and corresponding power components, which may include a ballast, LED driver, and/or other component.

In certain exemplary embodiments, the mounting brackets may include one or more bend-out tabs that allow the use of the same bracket in either 2-foot or 4-foot troffer retrofits. In some embodiments of the invention the retrofit design allows these retrofit kits to be used in luminaires as shallow as 3 inches, measured from a ceiling level to a viewing (bottom) end of the housing.

The systems and methods described herein may provide several advantages including maximizing energy savings, improving light quality, such as eliminating any 'cave-like' effect of traditional parabolic fixtures, as well as improving the overall aesthetics of existing parabolic and lensed troffers. The systems, methods, and apparatuses described herein may also allow for lower cost retrofit solutions, improved light uniformity and area coverage, reduced installation time, easier installation, reduced maintenance and labor costs, pollution reduction, and in some cases, may substitute less energy efficient components of existing recessed fluorescent luminaires with new energy savings components.

Turning now to the drawings, in which like numerals indicate like elements throughout the figures, exemplary embodiments are described in detail. As would be recognized by a person of ordinary skill having the benefit of the present disclosure, the claimed invention may be embodied in many different forms and should not be construed as limited to the exemplary embodiments depicted and described herein.

Figure 2:
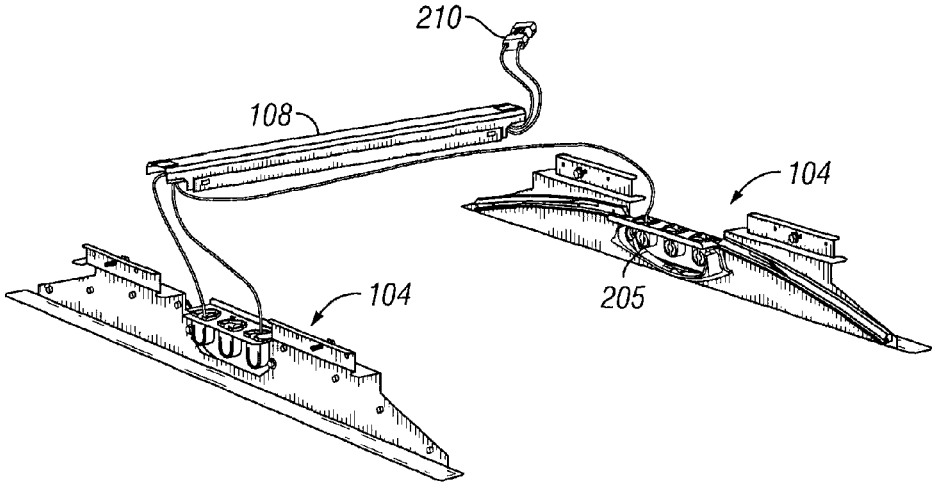
FIG. 2 illustrates certain components of an example retrofit "kit," in accordance with certain exemplary embodiments.
Figure 3:
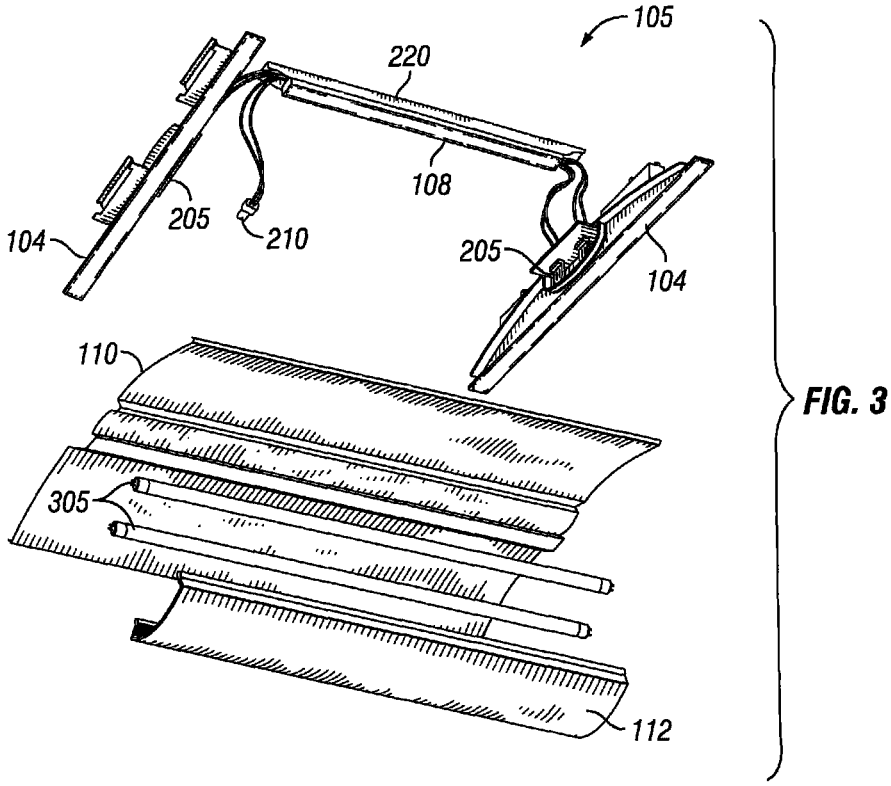
FIG. 3 is an exploded view of certain components of the retrofit kit of FIG. 2, in accordance with certain exemplary embodiments.

FIG. 1 is an exploded view of a top-level assembly of a retrofit linear lighting fixture 100, in accordance with certain exemplary embodiments. As shown in FIG. 1, an existing luminaire housing 102 may be retrofitted with a retrofit kit 105. The existing luminaire housing 102 includes a frame having a top and first and second side ends that collectively define an opening in which other components of the lighting fixture 100 are disposed. FIGS. 2 and 3 illustrate certain components of the fluorescent retrofit kit 105, in accordance with certain exemplary embodiments.

With reference to FIGS. 1-3, the kit 105 includes mounting bracket subassemblies 104, a splice cover 106, at least one ballast 108 (or other power component, such as an LED driver), a reflector panel 110, and a diffuser lens 112. In certain exemplary embodiments, one or more components of the kit 105 may not be included or may be optional components of the kit 105. For example, the splice cover 106 may not be needed in certain embodiments where the power wire is 18 AWG solid or if the existing housing 102 already has a splice cover (subject to regional interpretations of National Electric Code "NEC" requirements).

In certain exemplary embodiments, certain components of the kit 105 are pre-wired, thereby avoiding the need for wiring between the components as part of installation of the kit components. For example, the ballast(s) 108 and sockets 205 of the bracket subassemblies 104 are pre-wired together, with one or more electrical connectors 210, such as quick connectors, which can mate with one or more corresponding connectors (not shown) in the existing housing 102 or installation site to close an electrical circuit, which includes the ballast(s) 108, sockets 205, and lamps 305 (FIG. 3) installed between the sockets 205. Pre-wiring these components allows for a more efficient installation process because the installer can complete some or all required electrical connections for the light fixture 100 merely by snapping, sliding, or otherwise mating together pairs of pre-installed connectors 210.

In certain exemplary embodiments, this pre-wiring feature may allow for safe and efficient installation of the kit 105 by less skilled installers than are traditionally required for light fixture retrofitting. For example, because the installer may not have to wire together any electrical connections, as in traditional retrofitting solutions, the installer may not require any specialized electrical training. Thus, in addition to saving installation time, this solution may allow for reduced labor costs associated with hiring less skilled installers.

During installation, the ballast(s) 108 and bracket subassemblies 104 may be carried by the installer with one hand, leaving the other hand available to grab a ladder or portable drill, for example. In certain exemplary embodiments, an adhesive 220, such as a pressure sensitive, double-sided tape, a transfer adhesive, Velcro, and/or a mastic, may be located on a mounting side of each ballast 108 (or another retrofit kit component) as a temporary means for attaching the ballast(s) 108 to the existing housing 102. In addition, or in the alternative, the installation may involve placing an adhesive on the existing housing 102, for mating with the ballast 108 (or other retrofit kit component). In certain alternative exemplary embodiments, the installer may attach the adhesive 220 to the mounting side of the ballast(s) 108 as part of the installation process, instead of receiving the kit 105 with the adhesive 220 attached to the ballast(s) 108.

Provisional attachment of the ballast 108 (or other component) may free up the installer's hands for other installation requirements. For example, the installer may provisionally mount the ballast(s) 108 to the existent housing 102 via the adhesive 220 and then have free hands to turn and pick up a drill or other tool for completing a permanent installation of the ballast(s) 108 into the existent housing 102. The position of the installed ballast 108 (or other component) within the existing housing 102 may depend upon a variety of factors, including the size of the ballast 108, the length of the wires between the ballast 108 and each socket 205 and/or the power source for the fixture 100, etc. For example, the ballast 108 may be substantially centrally disposed between the sockets 205 in certain exemplary embodiments.

In certain exemplary embodiments, the ballast(s) 108 and/or other components of the kit 105 may include captive hardware features, such as captive screws, nails, bolts, clips, and/or another captive fastener means. Each item of captive hardware includes a fastener which is incorporated into a corresponding ballast 108 or other component such that it is fixed to the ballast 108 or other component. While the captive hardware is movable for installation purposes, the captive hardware is not readily removable from its corresponding ballast 108 or other component. Using captive hardware reduces the risk of losing fasteners or the need to pick up dropped fasteners as an additional delay to a successful installation.

For example, captive hardware may be incorporated on the bracket subassemblies 104, ballast(s) 108, the reflector panel 110, the splice cover 106, and/or the diffuser lens 112, for use in attaching one or more of these components to another component, the housing 102, and/or another surface. In certain exemplary embodiments, the same type of captive hardware (e.g., screws or other fasteners) may be used wherever possible to reduce the number of different parts, thereby reducing kit 105 complexity, kit 105 manufacture/assembly time, and related expense. However, a person of ordinary skill in the art will recognize that any combination of the same or different fasteners may be used in various exemplary embodiments.

Figure 4:
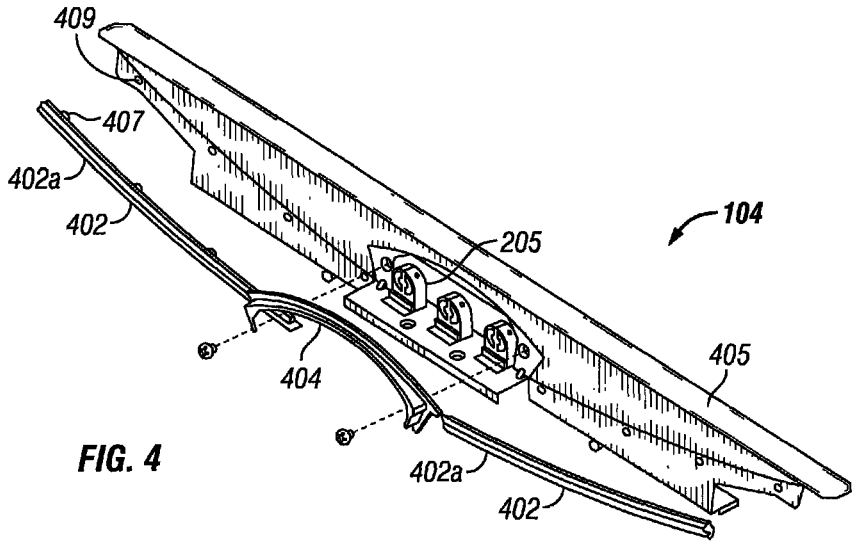
FIG. 4 illustrates a mounting bracket subassembly of the retrofit kit of FIG. 2, in accordance with certain exemplary embodiments.

FIG. 4 illustrates the bracket subassembly 104, in accordance with certain exemplary embodiments. With reference to FIGS. 1-4, the bracket subassembly 104 includes side reflector guides 402, a lens end cap 404, and sockets 205. As shown in FIG. 4, the side reflector guides 402 include substantially elongated members **402*a* that have curved profiles that correspond to the curved shape of the ends 110*a* of the reflector panel 110. Thus, when the reflector panel 110 is installed in the fixture 100, the side reflector guides 402 may support and add significant longitudinal stiffness to the reflector panel 110. For example, the ends 110*a* of the reflector panel 110 can sit on the reflector guides 402 when the reflector panel 110 is installed in the fixture 100. The side reflector guides 402 also control the shape (e.g., the parabolic shape shown in FIGS. 3-4) of the reflector panel 110**, for increased efficiency and/or illumination uniformity.

In certain exemplary embodiments, the side reflector guides 402 also can cover up any assembly gaps between ends of the reflector panel 110 and the ends of the bracket subassemblies 104 and provide a visual (or cosmetic) seal along the side edges of the reflector panel 110. For example, the assembly gaps may exist when the ends of the bracket subassemblies 104 are installed in different types of enclosures. Although the gaps would not physically be covered by the side reflector guides 402, the impression would be that no gap exists because the reflector panel 110 ends would "blend" with the side reflector guides 402 and provide a visually continuous seam.

Figure 5:
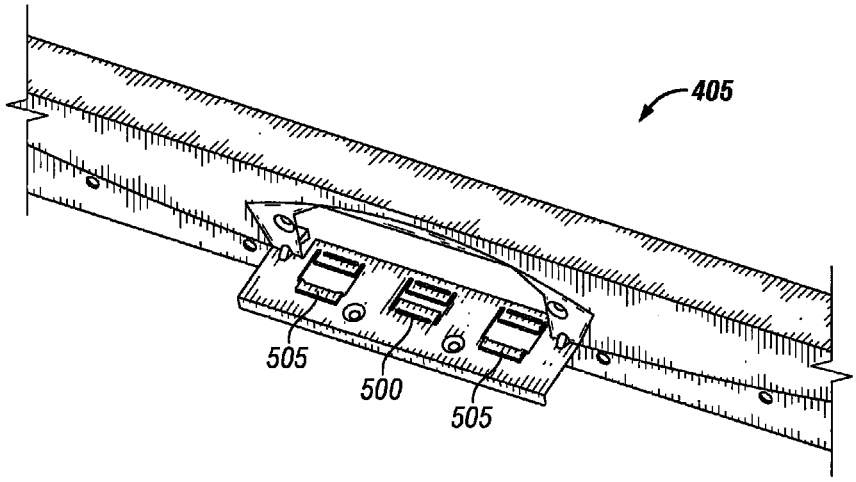
FIG. 5 illustrates socket location tabs included on the mounting bracket subassembly of FIG. 4, in accordance with certain exemplary embodiments.
Figure 6:
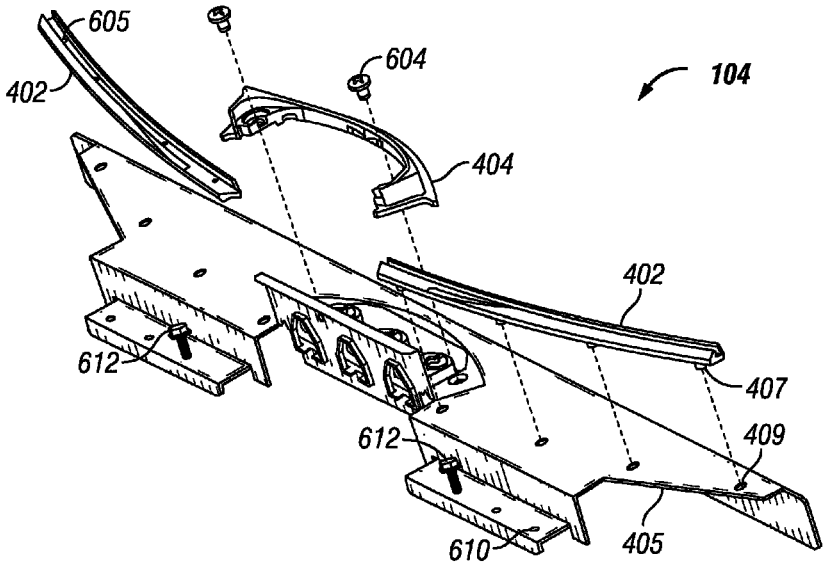
FIG. 6 is a partially exploded view of the mounting bracket subassembly of FIG. 4, in accordance with certain exemplary embodiments.
Figure 16:
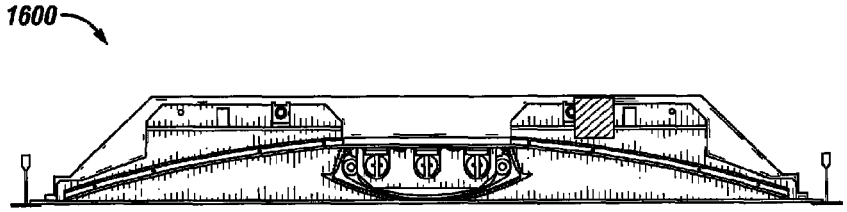
FIG. 16 illustrates a cross-section view of a retrofit solution for a lensed troffer linear lighting fixture, in accordance with certain exemplary embodiments.
Figure 23:
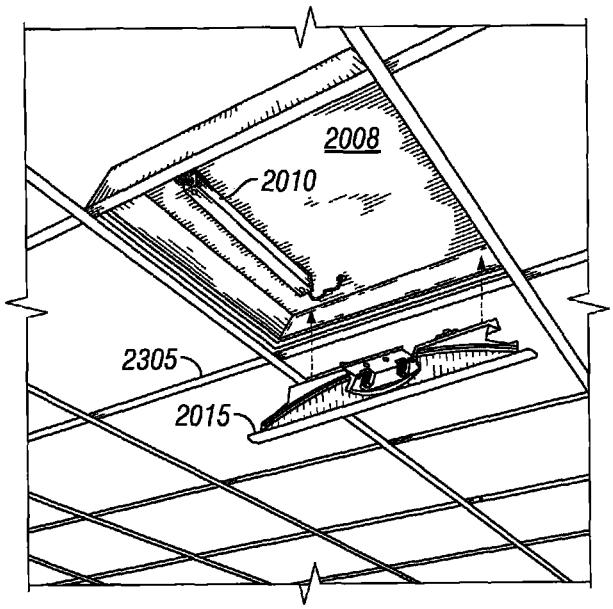
FIG. 23 illustrates an installer inserting the first bracket subassembly during the retrofitting method of FIG. 19, in accordance with certain exemplary embodiments.
Figure 24:
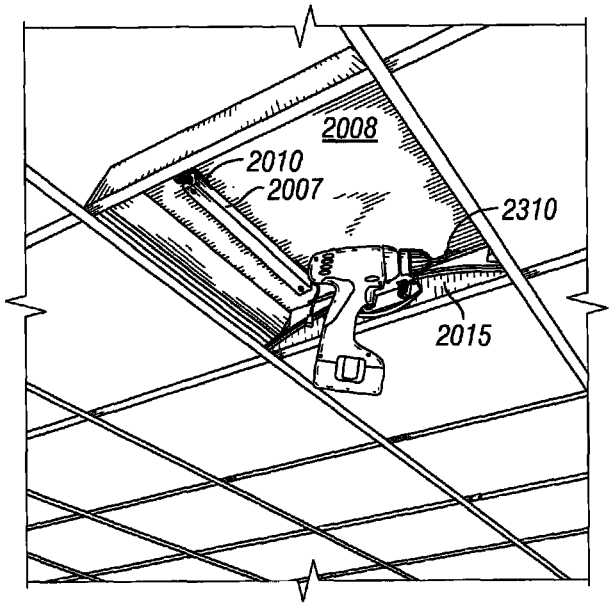
FIG. 24 illustrates an installer attaching the first bracket subassembly of FIG. 23 to the housing during the retrofitting method of FIG. 19, in accordance with certain exemplary embodiments.

The side reflector guides 402 and lens end cap 404 are coupled to a bracket 405 of the assembly 104, which extends substantially perpendicular to the longitudinal axis of the reflector panel 110 and lamps 305 (FIG. 3) of the fixture 100. Installation of an exemplary bracket subassembly (which may be substantially similar to the subassembly 104) within a fixture (such as fixture 100) is illustrated in FIGS. 23 and 24, which are described below. In certain exemplary embodiments, the side reflector guides 402 and/or lens cap 404 include injection molded materials that do not require additional hardware to be installed to the bracket 405. For example, as best seen in FIG. 5 described below, the side reflector guides 402 depicted in FIG. 4 include flexible features 407 like a "hook" that would bend and snap in while pressed into a corresponding hole 409 in the bracket 405. In some embodiments they match the color of the inner/outer reflector (e.g., white). As best seen in FIGS. 6 and 16 described below, the side reflector guides 402 may include a built-in channel 605 (FIG. 6) for an alternative design that includes a backlit luminous panel.

FIG. 5 illustrates socket location tabs 500 included on the bracket 405, in accordance with certain exemplary embodiments. In the exemplary embodiment shown in FIG. 5, the socket locations 500 are marked using visible stamping numbers and/or letters. These locations may be selected depending on the fixture size and the number of lamps to be utilized in the retrofit solution, and the selected locations revealed by bending out the appropriate tabs 500 sometime prior to installation or even bending out the appropriate tabs 500 on the assembly line during the kit manufacturing process.

In the exemplary embodiment depicted in FIG. 5, tabs 505 are bent out of the bracket 405. Although depicted in FIG. 5 as remaining attached to the bracket 405 after being bent out, a person of ordinary skill in the art will recognize that the bent out tabs 505 may snap out or otherwise separate from the bracket 405 in alternative exemplary embodiments. Bending and/or removing the tabs 500 creates an opening for the sockets 205 to be inserted in the bracket 405, as illustrated in FIG. 4. For example, each socket 205 may snap into the bracket 405, in a position substantially aligned with the opening formed from bending out the tab 500 corresponding to the socket 205. For instance, some bend-out tab(s) 500 on the bracket 205 may be for two-by-two foot troffers and other bend-out tab(s) 500 may be for two-by-four foot troffers.

FIG. 6 illustrates an exploded view of the bracket subassembly 104, in accordance with certain exemplary embodiments. With reference to FIGS. 1-6, the bracket subassembly 104 includes a bracket 405, side reflector guides 402 with snap-in plastic features 407 for coupling to the bracket 405, a lens cap 404, self tapping screws 604 for coupling the lens cap 404 to the bracket 405, and self-drilling captive screws 612 and/or (fastener-receiving) holes 610 for installing the bracket subassembly 104 in a light fixture housing, such as the existent housing 102 depicted in FIG. 1. In certain exemplary embodiments, a profile of the bracket subassembly 104 or the bracket 405 (or one or more other portions of the bracket subassembly 104) may be universal to fit many types of pre-existing fixture housings. Moreover, in some example embodiments of the invention, the socket configuration in the mounting bracket may be adjusted in the field to adapt for alternative numbers and arrangements of lamps (such as between 1, 2, and 3 lamps), for added flexibility in achieving desired light levels in various retrofit solutions. This versatility in the bracket design simplifies the process of manufacturing brackets for retrofit kit solutions and avoids the need for using a variety of tooling, thereby further reducing manufacturing costs.

In certain exemplary embodiments, the bracket 405 may include a pre-painted sheet metal bracket. Because it requires no in-plant painting either before or after fabrication, pre-painted steel sheet eliminates the manufacturer's capital burden for providing or using paint facilities as well as paint-line costs associated with the preparation, handling, spraying, and baking or drying operations. In addition, the use of pre-painted steel sheet eliminates the costs of meeting stringent air-quality standards and paint-chemicals disposal requirements.

Figure 7:
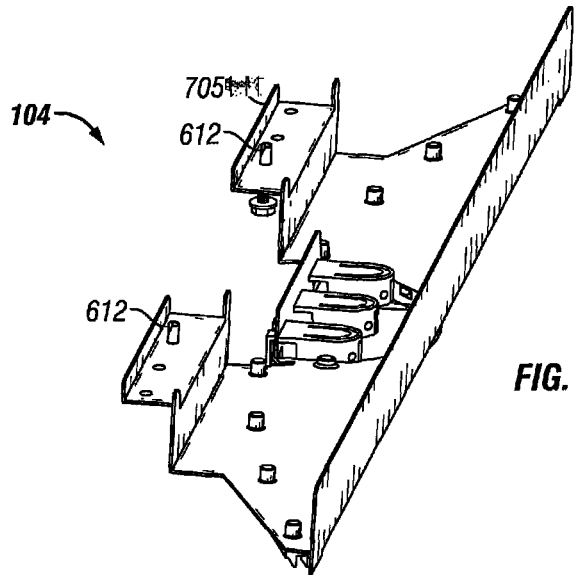
FIG. 7 illustrates a bottom view of the mounting bracket subassembly of FIG. 4, in accordance with certain exemplary embodiments.
Figure 8:
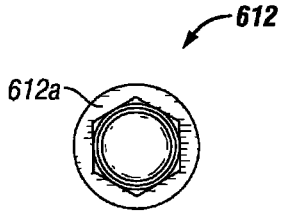
FIG. 8 illustrates a view of a head of a self-drilling captive screw of the mounting bracket subassembly of FIG. 4, in accordance with certain exemplary embodiments.
Figure 9:
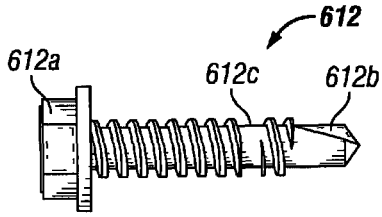
FIG. 9 illustrates a side view of the self-drilling captive screw of FIG. 8, in accordance with certain exemplary embodiments.

FIG. 7 illustrates a bottom view of the bracket subassembly 104, in accordance with certain exemplary embodiments. In particular, FIG. 7 shows more clearly the self drilling captive screws 612 for installing the bracket subassembly 104 in a light fixture housing, such as the existing housing 102 depicted in FIG. 1. FIG. 8 illustrates a view of a head 612*a* of a self drilling captive screw 612, in accordance with certain exemplary embodiments. FIG. 9 illustrates a side view of the self drilling captive screw 612, in accordance with certain exemplary embodiments.

With reference to FIGS. 7-9, the self drilling captive screws 612 are incorporated into the bracket 405 such that they won't fall out during installation. In other words, they are "captive" in the bracket 405 prior to and throughout installation. For example, as best seen in FIG. 9, the self drilling captive screw 612 may include a non-threaded portion 612*c* flanked between threaded portions 612*a* and 612*b*. Prior to installation, a portion of the bracket 405 may rest around the portion 612*c*, substantially between the threaded portions 612*a* and 612*b* so that the portion of the bracket 405 is sandwiched between the threaded portions 612*a* and 612*b*. Thus, the bracket 405 and screw 612 are not generally movable absent a deliberate force, which is used to advance the screw 612 for installation purposes.

Including such captive hardware can eliminate the risk of dropping or losing hardware before or during the installation process. Each screw 612 includes a "drill bit-style" point 612*b* that, upon positive rotation of the screw 612 relative to an installation surface (such as a ceiling or housing), drills its own pilot hole in the installation surface. Thus, the installer may simply rotate the screw 612 without first having to drill a pilot hole in the installation surface, reducing time and effort required for installation. As illustrated in FIG. 7, prior to installation of the screw 612, the end 612*b* is disposed substantially below outer, interfacing edges (including, e.g., edge 705) of the bracket 405 so that, when placing the bracket 405 against its installation surface, only the interfacing edges of the bracket 405 touch the installation surface. Thus, the screw 612 does not inhibit a press fit of the bracket 405 against the installation surface.

In certain exemplary embodiments, each screw 612 is installed in the bracket 405 by applying 1-2 rotations to the screw 612 coupled with some axial force. Once the screw 612 is in the non-threaded portion 612*c*, the axial force is stopped, keeping the screw 612 from advancing more than the desired amount. During installation, the installer applies a torque to the screw head 612*a* and an axial force to create a hole using the self drilling screw tip 612*b*, in the installation surface (such as ends of the housing 102). Unless the hole is drilled in the installation surface, the screw 612 rotates in the bracket hole but doesn't advance relative to the bracket hole. The installer applies the axial force to make the screw 612 advance and tighten the bracket 405 to the installation surface.

In certain exemplary embodiments, each screw 612 is formed by pressing one or more shaped dies against a blank (cylinder) while the dies and/or blank rotate. The dies contact the blank when forming the threads. The contact is removed for at least one or two rotations so that the threads are not formed in the non-threaded portion 612*c*.

Figure 10:
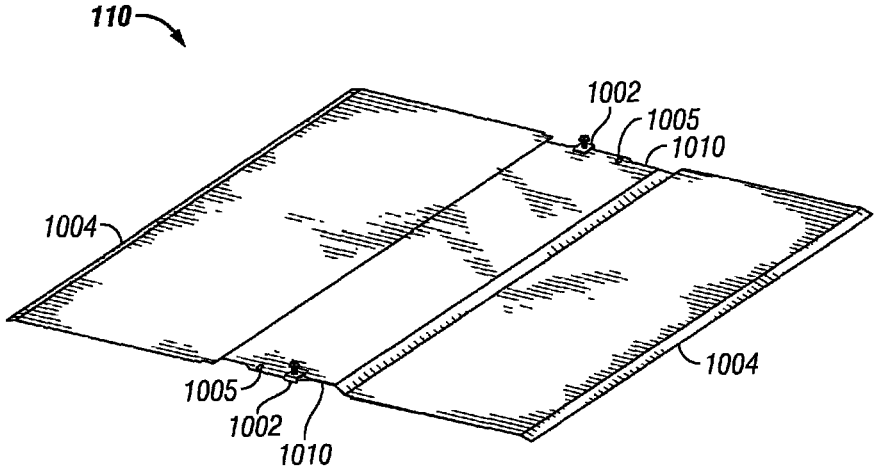
FIG. 10 illustrates a reflector panel of the retrofit kit of FIG. 2, in accordance with certain exemplary embodiments.

FIG. 10 illustrates the reflector panel 110, in accordance with certain exemplary embodiments. With reference to FIGS. 1-3 and 10, the reflector panel 110 includes one or more members with a reflective surface formed on one or both sides, or coupled thereto, for reflecting light from the lamps 305 of the fixture 100. In certain exemplary embodiments, the reflector panel 110 is sized to fit troffer housings as shallow as 3 inches.

While the locations of the mounting bracket subassemblies 104 within the fixture are roughly set by the existing features of a fixture housing 102, the reflector panel 110 may set the spacing of the other fixture components more precisely. Captive screws 1002 in the reflector panel 110 are installed in extruded holes of a socket plate of each bracket subassembly 104. The distance between the socket plates is set primarily by the reflector panel 110 as a minimum distance. The distance between the bracket subassemblies 104 may be adjusted by moving the screws 1002 from round holes in which they are disposed in FIG. 10 (where they are installed by factory) into oblong holes 1005 of the reflector.

As shown in the embodiment of FIG. 10, the reflector panel 110 may be of one-piece construction. This construction simplifies the manufacturing process and tooling for creating the reflector panel 110. Further, the reflector panel 110 may be made from a wide variety of materials and highly reflective for increased light efficiency (e.g., painted sheet metal or highly reflective plastic sheet). In certain exemplary embodiments, the reflector panel 110 may provide a slight pre-load to reduce vibrations that may be associated with the large surface of the reflector panel 110 when the reflector panel 110 is installed. The reflector can be flexed by the installer and, when released, be trapped between the side reflector guides 402 and lens 112 such that it cannot return to its free state. This is beneficial because the pre-load would keep the reflector tight in place as a constrained spring. Moreover, for some embodiments, vibrations may be drastically reduced by elastic material properties of the reflector panel 110. As best seen in FIG. 10, opposite ends of the reflector panel 110 include flanges 1004. By changing the formed flange's 1004 direction and/or size, the reflector panel 110 can allow air flow into the fixture. This may be useful for retrofitting air handling/air return fixtures as well as standard fixtures. Further, the reflector panel 110 and/or the formed flanges 1004 may cover unwanted gaps or black brackets of existing housings.

As for the installation of the reflector panel 110, the reflector panel 110 may be captured under the lens end caps 404 and fixed in place with at least one fastener 1002 (e.g., screws, bolts, or other fasteners), which may include captive hardware 1002. For example, the reflector panel 110 may be positioned within the fixture and secured to the ballast 108 via the fastener(s) 1002. In certain exemplary embodiments, the reflector panel 110 includes clearance notches 1010 that allow the installer to install the reflector panel 110 while the lens end caps 404 are installed on the bracket subassemblies 104. By sliding the reflector panel 110 above the lens end caps 404 and under the side reflector guides 402 and combined with the pre-load of the reflector panel, there is a partial capture of the reflector panel 110 in the housing enclosure 102. Thus, the installer can take both hands off the reflector panel 110 without any risk of falling objects and use one hand to pick up the drill and the other one to position the reflector 110 more accurately or simply to hold onto a ladder. Captive hardware 1002 on the panel 110 may reduce installation time and improve the ease of installation for the installer. Further, in some embodiments, the reflector panel 110 may be of a universal design to lay-in lensed and/or louver lay-in troffers.

Figure 11:
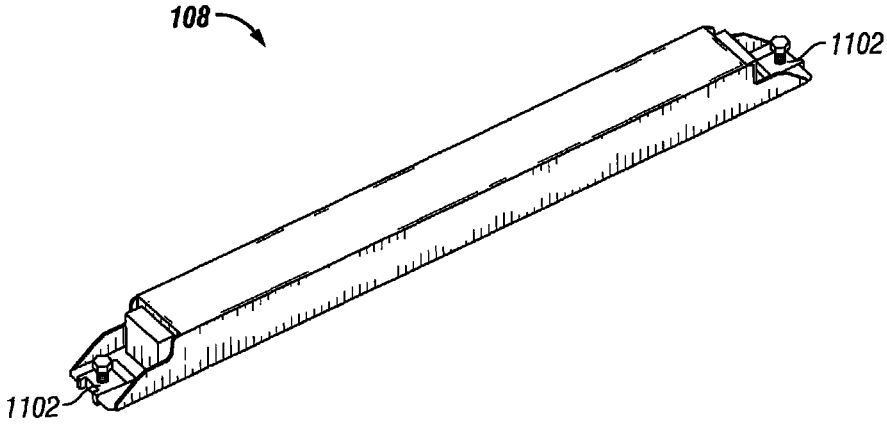
FIG. 11 illustrates a ballast of the retrofit kit of FIG. 2, in accordance with certain exemplary embodiments.

FIG. 11 illustrates the ballast 108, in accordance with certain exemplary embodiments. As shown in FIG. 11, the ballast 108 may have captive hardware 1102 (clips, screws, or other fastener) for ease of installation. In certain exemplary embodiments, the captive hardware 1102 may be re-used during new ballast replacement or maintenance. In other words, the captive hardware 1102 clips and/or screws can be removed from the ballast 108 and installed on another ballast 108 (if maintenance occurs), making that new ballast 108 replacement easy to install upside down into the housing 102 (FIG. 1).

In certain exemplary embodiments, there is no need for a ballast tray (which typically holds ballasts in conventional retrofit solutions). For example, when using independently mounted brackets 405 and an adhesive 220 (such as double-sided tape) to hold the ballast(s) 108 while installing the kit 105, a ballast tray may not be required. UL compliance may be maintained with installation per the applicable installation instructions.

Figure 12A:
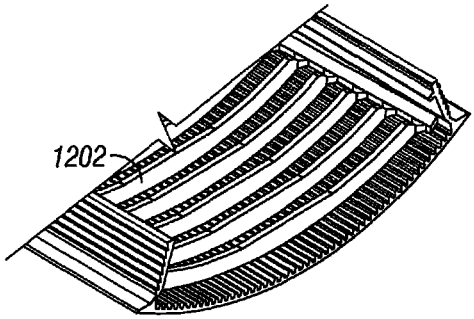
FIGS. 12A, 12B, and 12C, illustrates a diffuser lens and an optional internal baffle, which may be included in the retrofit kit of FIG. 2, in accordance with certain exemplary embodiments.
Figure 12B:
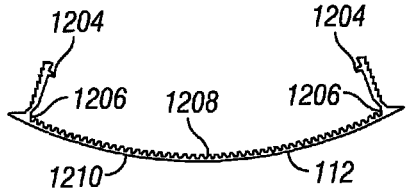
Figure 12C:
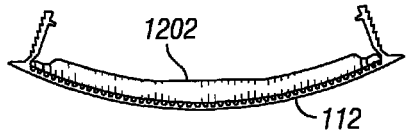
Figure 13:
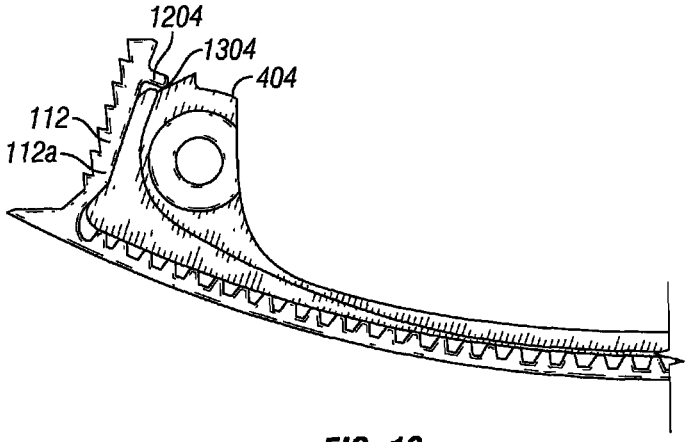
FIG. 13 illustrates the diffuser lens of FIG. 12 installed on a lens end cap, in accordance with certain exemplary embodiments.

FIG. 12 illustrates the diffuser lens 112 and an optional internal baffle 1202, which may be included in the retrofit kit 105, in accordance with certain exemplary embodiments. FIG. 13 illustrates the diffuser lens 112 installed on the lens end cap 404, in accordance with certain exemplary embodiments. With reference to FIGS. 1-6 and 12-13, the diffuser lens 112 includes an optically transmissive or clear, refractive or non-refractive material (not shown) that provides environmental protection for the lamps 305 and other internal components of the light fixture 100 while also transmitting light from the lamps 305 into a desired environment. For example, the lens 112 may include a combination of clear and frosted materials for different light levels. In some embodiments, the lens 112 may be made of an acrylic material (e.g., extruded or co-extruded acrylic) for longer life, especially under UV exposure from the fluorescent lamps 305.

In certain exemplary embodiments, the lens 112 includes one or more snap in features 1204 that allow the lens 112 to be easily removed and installed. For example, as best seen in FIG. 13, each snap in feature 1204 may have a snap-fit engagement with an edge of the lens end cap 404. Each snap in feature 1204 protrudes from a main body 112*a* of the lens 112, which is flexible to allow the feature 1204 to move relative to the lens end cap 404. Although depicted in FIG. 13 as extending substantially perpendicularly from the main body 112*a*, a person of ordinary skill in the art will recognize that each snap in feature 1204 may extend at various different angles relative to the main body 112*a* in certain alternative exemplary embodiments. The snap in features 1204 can allow for efficient and easy re-lamping of the light fixture 100.

In certain exemplary embodiments, an optional internal louver/baffle 1202 may fit inside the lens 112, trapped between mounting 'feet' (or baffle capture channels) 1206 for one-step, simple installation. An internal baffle 1202 can be easier to handle because it will stay with the lens 112 while re-lamping. In the embodiment shown in FIG. 12, the optional baffle 1202 is an injection molded part and made out of two segments that may be welded together for a four foot long fixture and one piece for a two foot long fixture. In the embodiment shown in FIG. 12, micro-prisms are included on the inner surface 1208 of the lens 112 for uniform light distribution, while the outer surface 1210 of the lens 112 is smooth, facilitating ease of cleaning and upkeep. A person of ordinary skill in the art will recognize that the baffle 1202 may have other manufacturing and size characteristics in alternative exemplary embodiments.

The lens end cap 404 (best seen in FIG. 13) can connect to (or capture) a variety of lenses via a positive lens capture or locking portion 1304 of the end cap 404. The locking portion 1304 includes a substantially angled member, which resists movement of the snap in feature 1204 relative to the end cap 404. As shown in the embodiment of FIG. 13, a lens 112 may be easily installed or removed from the end cap 404 using finger pressure.

Figure 14A:
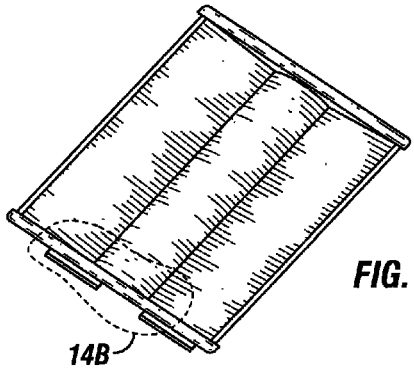
FIGS. 14A, 14B, and 14C, illustrates a cross-section of a lens end cap, lens, mounting bracket subassembly, lamp, and socket connection end of a retrofit linear lighting fixture, in accordance with certain exemplary embodiments.
Figure 14B:
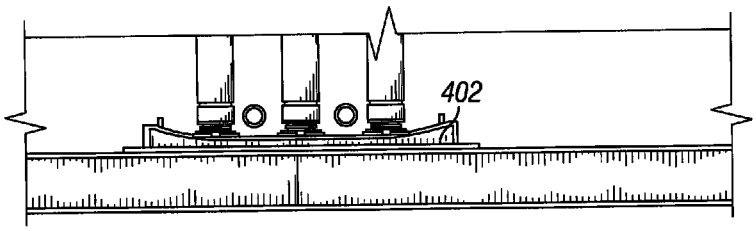
Figure 14C:
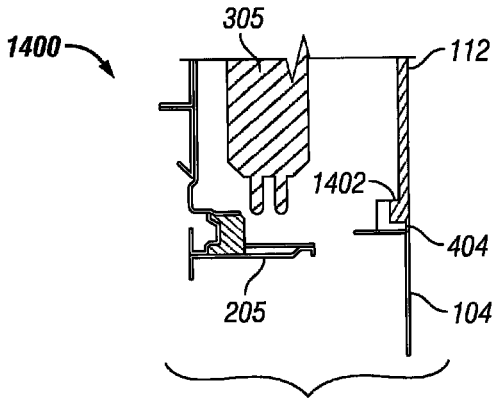

FIG. 14 illustrates a cross-section 1400 of the lens end cap 404, lens 112, mounting bracket subassembly 104, lamp 305, and socket 205 connection end of a fluorescent retrofit lighting fixture 100, in accordance with certain exemplary embodiments. As shown in FIG. 14, the (potentially injection molded) end cap 404 may act as a light leak cover 1402 and a support for the lens 112, and in some embodiments, for an optional baffle.

Figure 15:
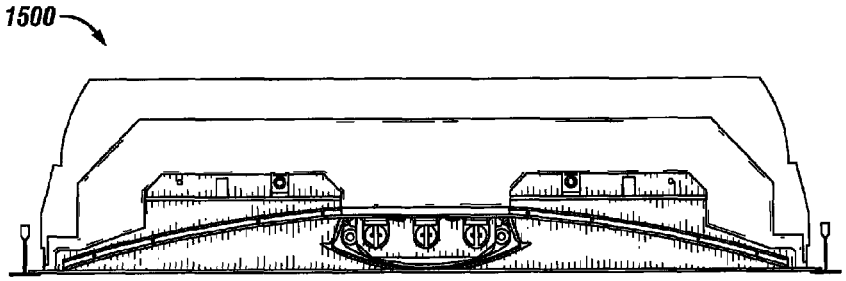
FIG. 15 illustrates a cross-section view of a retrofit solution for a parabolic linear lighting fixture, in accordance with certain exemplary embodiments.

FIG. 15 illustrates a cross-section view of a retrofit solution 1500 for a parabolic fluorescent lighting fixture, in accordance with certain exemplary embodiments. As shown in FIG. 15, a retrofit kit embodiment as described herein may be used with both shallow troffers and deep parabolic housings of different shapes.

FIG. 16 illustrates a cross-section view of a retrofit solution 1600 for a lensed troffer fluorescent lighting fixture, in accordance with certain exemplary embodiments. Typically the lensed troffer retrofit solution 1600 would be for retrofitting a 3-inch deep troffer. However, a person of ordinary skill in the art would recognize that the solution 1600 may be used in connection with troffers of various different sizes or depths.

Figure 17:
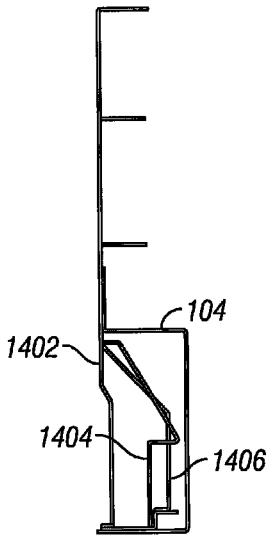
FIG. 17 illustrates alternative housing end cap profiles, demonstrating the versatility of the mounting bracket subassemblies of the kit of FIG. 2, in accordance with certain exemplary embodiments.

FIG. 17 illustrates alternative housing end cap profiles 1702, 1704, and 1706, demonstrating the versatility of the mounting bracket subassemblies 104, in accordance with certain exemplary embodiments of the invention.

Figure 18:
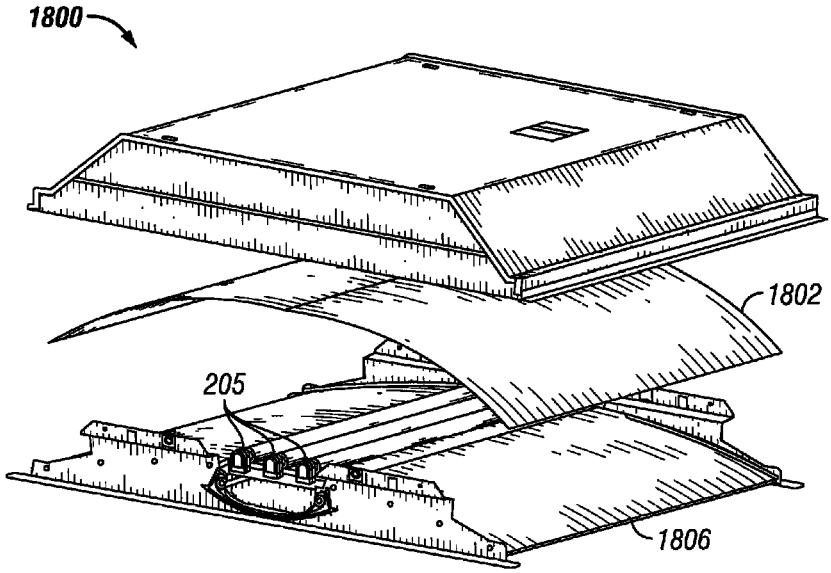
FIG. 18 illustrates an exploded view of a retrofit solution for a backlit luminous panel linear lighting fixture, in accordance with certain alternative exemplary embodiments.
Figure 19A:
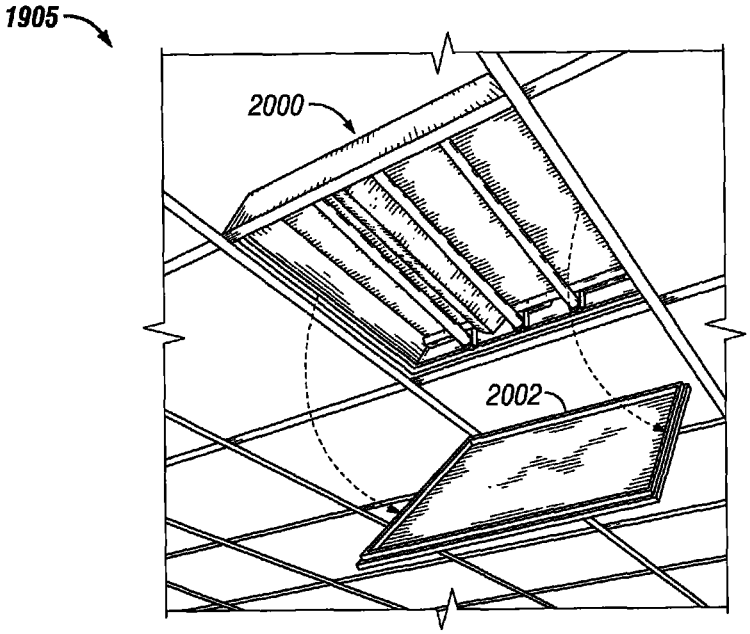
Figure 19B:
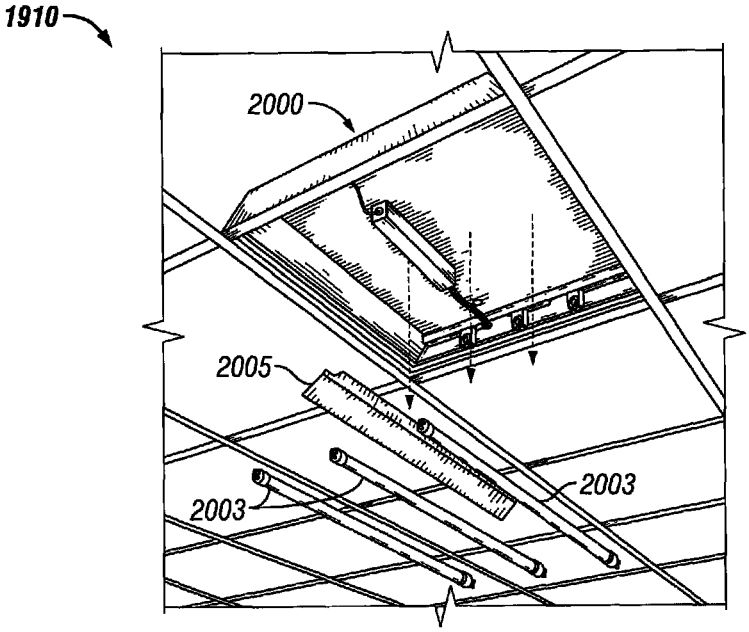
Figure 19C:
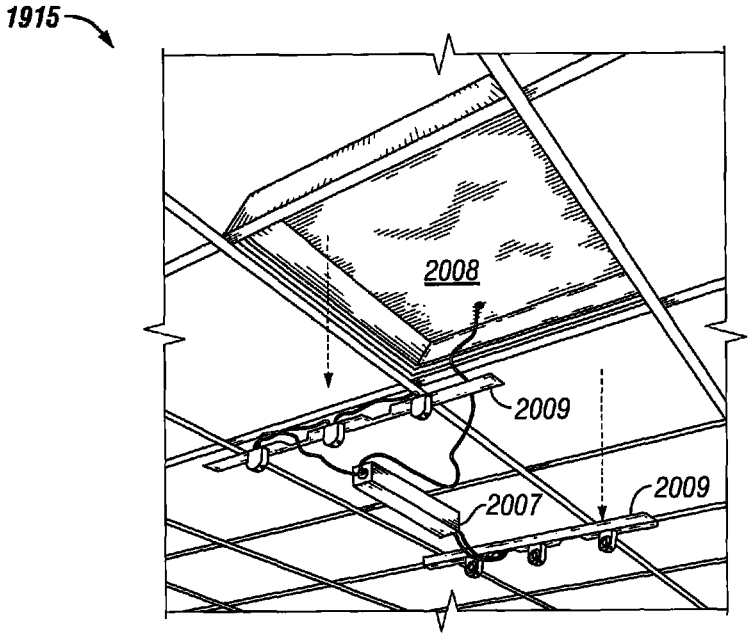
Figure 19D:
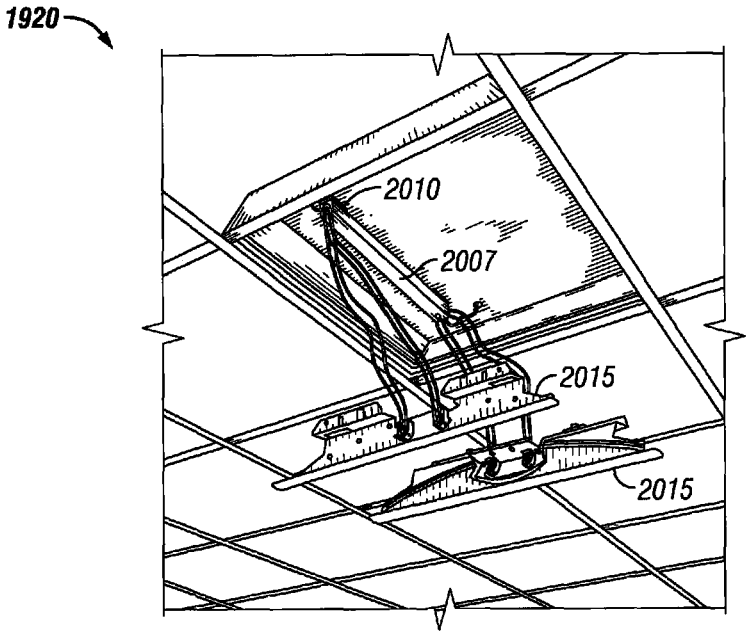
Figure 19E:
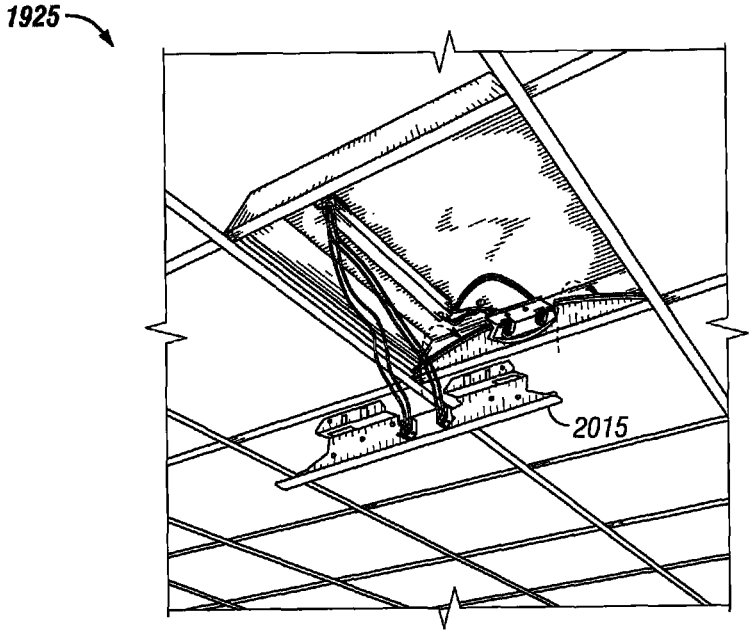
Figure 19F:
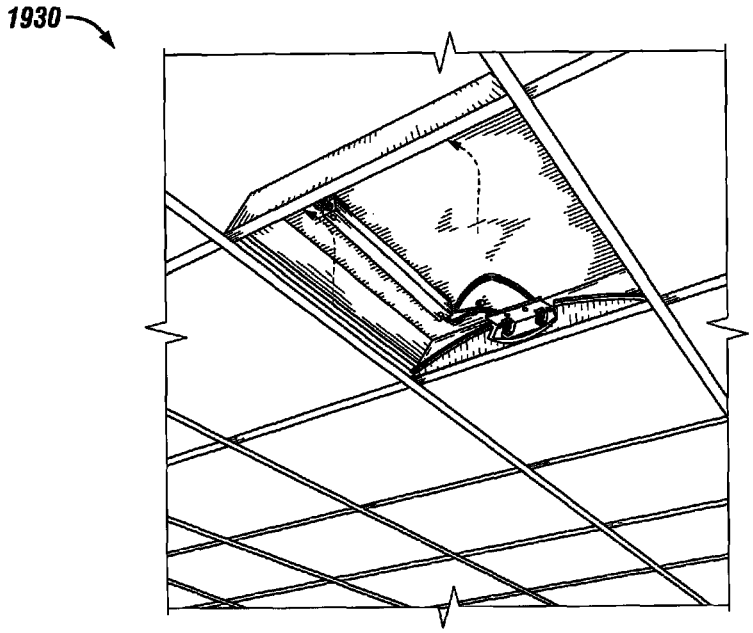
Figure 19G:
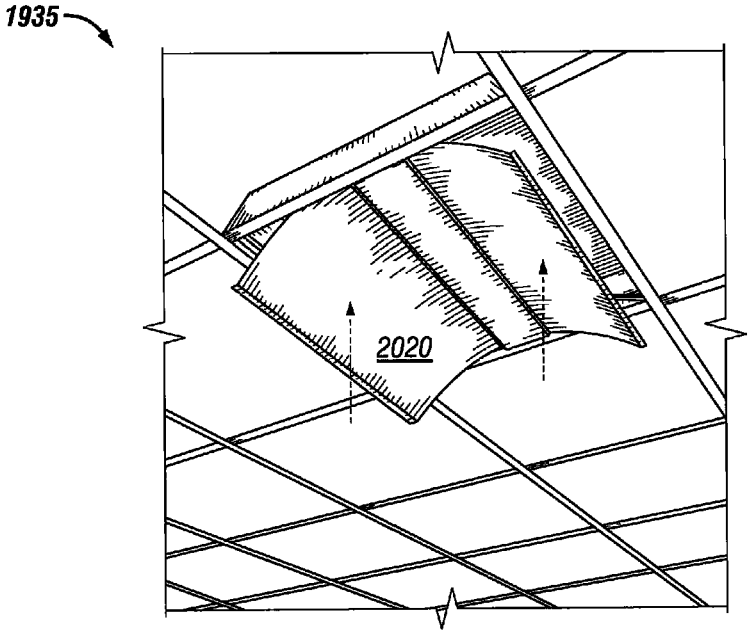
Figure 19H:
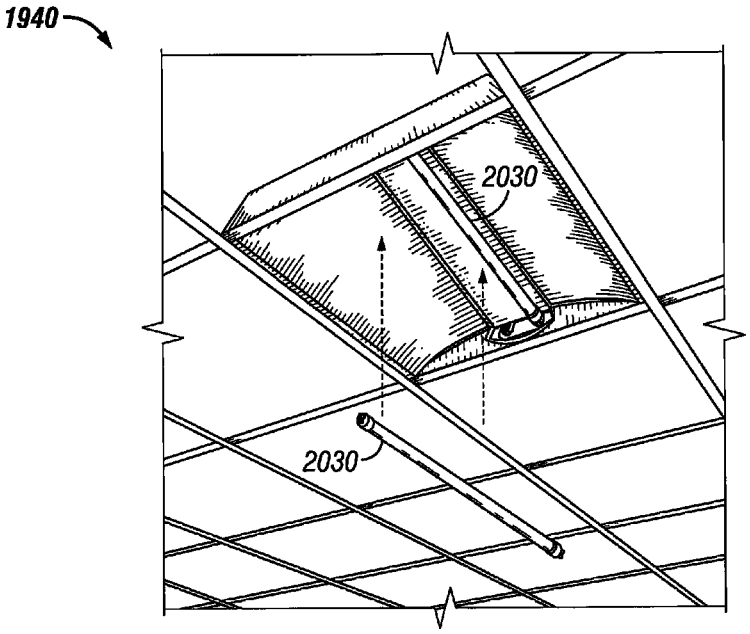
Figure 19I:
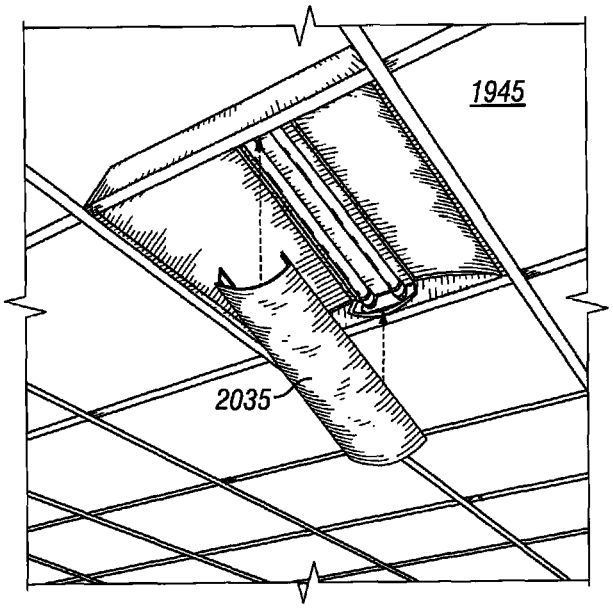

FIG. 18 illustrates an exploded view of a retrofit solution 1800 for a backlit luminous panel fluorescent lighting fixture, in accordance with certain alternative exemplary embodiments. The construction for the retrofit solution 1800 is similar to other embodiments of the invention except the lamps 305 sit above one or more translucent side lenses 1806 for a backlighting effect. An inner reflector 1802 may also be provided for increased efficiency and uniformity. The translucent side lenses 1806 may be located by the same side reflector guides. As shown in FIG. 18, this backlighting effect may be accomplished with the sockets 205 installed inverted from their configuration in other embodiments of the invention.

FIG. 19 depicts a method for retrofitting a recessed light fixture, in accordance with certain exemplary embodiments. In step 1905, an installer removes an existing door frame 2002 from an existing recessed lighting fixture 2000 (which may be substantially similar or different than the fixture 100 described above). If the fixture 2000 does not include a door frame 2002, the method 1900 may instead begin at step 1910, where the installer removes each lamp 2003 from the fixture 2000, as well as a gear tray 2005, if any, of the fixture 2000. In step 1915, the installer removes each ballast 2007 and bracket assembly 2009 (including sockets) from the fixture 2000. Upon removing each of these components, the only feature remaining (in the ceiling) from the fixture 2000 is the housing 2008 of the fixture 2000 (which may be substantially similar to or different than the housing 102 described above).

Figure 20:
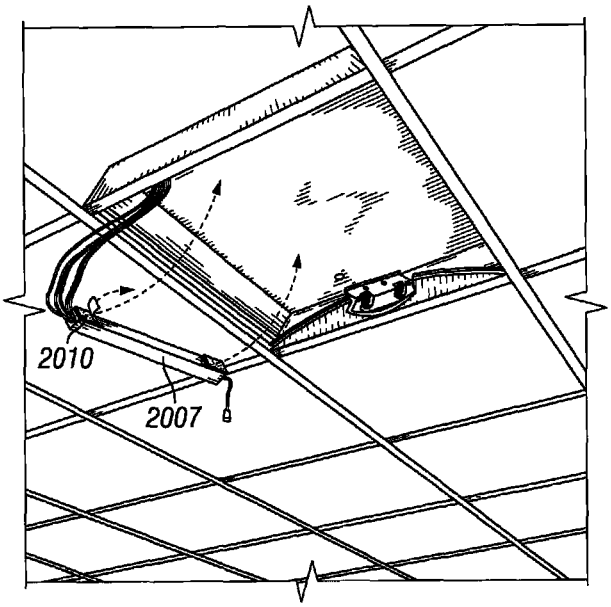
FIG. 20 illustrates an installer peeling protective paper from a two sided adhesive tape on a mounting side of a ballast during the retrofitting method of FIG. 19, in accordance with certain exemplary embodiments.
Figure 21:
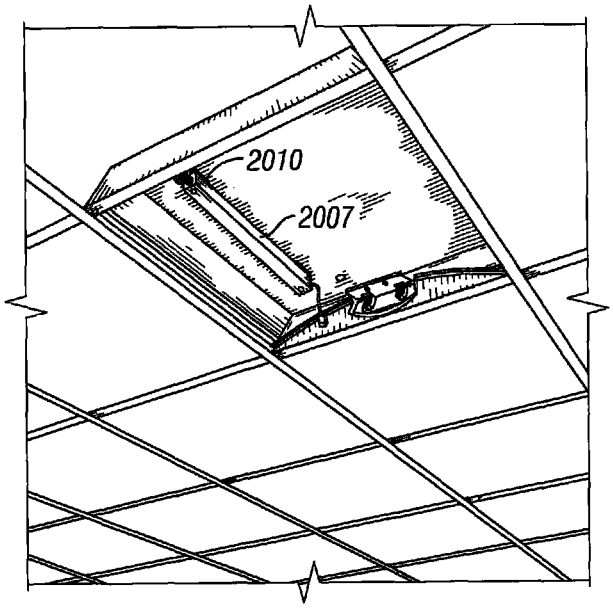
FIG. 21 illustrates an installer provisionally mounting the ballast against the interior surface of the housing during the retrofitting method of FIG. 19, in accordance with certain exemplary embodiments.
Figure 22:
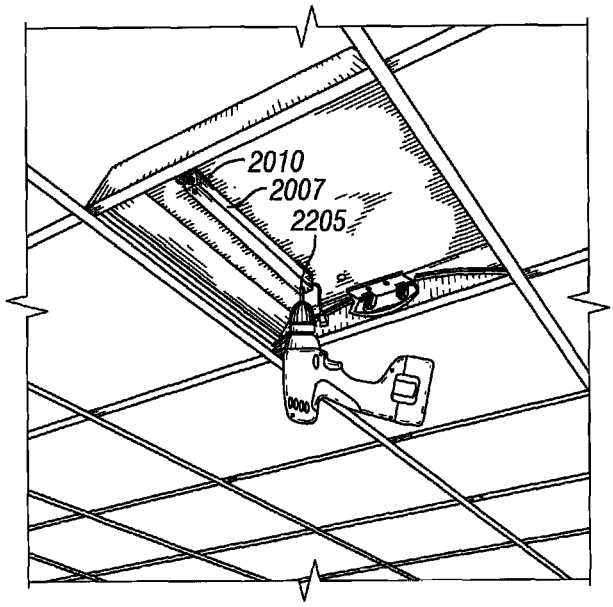
FIG. 22 illustrates an installer permanently mounting the ballast against the interior surface of the housing during the retrofitting method of FIG. 19, in accordance with certain exemplary embodiments.

In step 1920, the installer installs each ballast 2007 (which may be substantially similar to or different than the ballast 108 described above). As described above, this step 1920 may involve, for each ballast 2007, provisionally attaching the ballast 2007 to the housing 2008 via an adhesive, such as a double-stick tape, and then permanently attaching the ballast 2007 via one or more captive hardware elements. FIGS. 20-22 illustrate installation of the ballast 2007, in accordance with certain exemplary embodiments. In FIG. 20, an installer is peeling protective paper from a two-sided adhesive tape 2010 on a mounting side of the ballast 2007. In FIG. 21, the installer presses the mounting side of the ballast 2007 against the interior surface of the housing 2008, provisionally adhering the ballast 2007 to the housing 2008 via the tape 2010. In FIG. 22, the installer permanently mounts the ballast 2007 to the housing 2008 via one or more captive hardware elements 2205.

Returning to FIG. 19, in step 1925, the installer installs a first bracket subassembly 2015 (which may be substantially similar to or different from the subassembly 104 described above). As set forth above, this step 1925 may involve actuating one or more captive hardware features to secure the bracket subassembly 2015 to an end wall of the housing 2000. For example, each captive hardware feature can include a self drilling captive screw, such as the screw 612 depicted in FIGS. 6-9. FIGS. 23-24 illustrate installation of the first bracket subassembly 2015, in accordance with certain exemplary embodiments. In FIG. 23, the installer inserts the first bracket subassembly 2015 between the housing 2008 and a ceiling grid 2305 and against one end wall of the housing 2008. In FIG. 24, the installer attaches the bracket subassembly 2015 to the end wall of the housing 2008 using pre-installed self-drilling captive screws 2310.

Returning to FIG. 19, in step 1930, the installer repeats the procedure of step 1925 to install a second bracket subassembly 2015 against an opposing end wall of the housing 2008. As set forth above, installing the bracket subassemblies 2015 may involve electrically coupling together sockets (which may be substantially similar to or different than the sockets 205 described above) in the bracket subassemblies 2015 with the ballast(s) 2007 and/or electrically coupling ballast(s) 2007 with a power supply for the light fixture via one or more electrical connectors, such as the connectors 210 depicted in FIG. 3.

In step 1935, the installer installs a reflector 2020 (which may be substantially similar to or different than the reflector 110 described above) in the housing 2000 by coupling opposing edges of the reflector 2020 to the bracket subassemblies 2015. The reflector 2020 may be substantially similar to or different from the reflector panel 110 described above. In certain exemplary embodiments, the reflector 2020 serves the additional purpose of a wire/ballast cover. In some embodiments, re-lamping may be done without removing the reflector 2020 and if so, may be done so in compliance with Underwriters Laboratories (UL) requirements.

In step 1940, the installer installs one or more lamps 2030 in the fixture by connecting the lamps 2030 to sockets in the bracket subassemblies 2015. As described above, this step may involve selecting and bending socket tabs (such as tabs 505 in FIG. 5) to select appropriate sockets for the lamps 2030. In step 2035, the installer installs a lens 2035 (which may be substantially similar to or different from the lens 112 described above). For example, the installer may install the lens 2035 by snapping ends of the lens 2035 in place, as described in connection with FIG. 13 above.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A kit for retrofitting a preexisting recessed light fixture housing mounted in a ceiling plane, the preexisting recessed light fixture housing having an upper base panel and opposed end walls extending generally downward from the upper base panel, the kit comprising:

a first mounting bracket configured to be coupled to a first end wall of the opposed end walls of the preexisting recessed light fixture housing and comprising a first electrical socket;

a second mounting bracket configured to be coupled to a second end wall of the opposed end walls of the preexisting recessed light fixture housing and comprising a second electrical socket, the first and second electrical sockets completing a circuit with a lamp when the lamp is installed between the first and second electrical sockets;

a ballast that provides power to the circuit when the retrofit kit assembly is installed in the recessed light fixture and that is configured to be coupled to the upper base panel of the preexisting recessed light fixture housing; and an adhesive disposed on a mounting side of the ballast and provisionally mounting the ballast to the upper base panel of the housing prior to installation of a fastener, which permanently mounts the ballast to the upper base panel of the housing.

2. The kit of claim 1, wherein the adhesive comprises a double-sided tape.

3. The kit of claim 1, wherein each mounting bracket comprises captive hardware, which is pre-installed in the mounting bracket and designed to be movable relative to the mounting bracket only upon application of deliberate force with respect to the captive hardware, the captive hardware configured to couple the mounting bracket to the housing.

4. The kit of claim 1, wherein at least one of the first and second electrical sockets is disposed adjacent a bendable tab in its corresponding mounting bracket.

5. The kit of claim 1, wherein the ballast and sockets are pre-wired with at least one connector, which mates with another connector to complete the circuit.

6. The kit of claim 1, further comprising a reflector panel, wherein the first mounting bracket comprises a first curved side reflector guide having a first channel and coupled to a surface of the first mounting bracket, wherein the second mounting bracket comprises a second curved side reflector guide having a second channel and coupled to a surface of the second mounting bracket, and wherein the first mounting bracket and the second mounting bracket are configured to control a shape of the reflector panel.

7. The kit of claim 6, wherein the reflector panel comprises at least two formed flanges on opposing longitudinal edges of the reflector panel.

8. The kit of claim 1, further comprising:

at least one first lens end cap coupled to the first mounting bracket;

at least one second lens end cap coupled to the second mounting bracket; and a diffuser lens held in place by the at least two lens end caps and the mounting bracket.

9. The kit of claim 1, wherein the fastener, which permanently mounts the ballast to the upper base panel of the housing comprises captive hardware, which is pre-installed in the ballast and designed to be movable relative to the ballast only upon application of deliberate force with respect to the captive hardware.

10. A method of retrofitting a preexisting recessed light fixture housing mounted in a ceiling plane, the preexisting recessed light fixture housing having an upper base panel and two opposed end walls extending generally downward from the upper base panel, the method comprising the steps of:

providing first and second mounting brackets, each mounting bracket comprising an electrical socket;

providing a ballast that is pre-wired to each electrical socket;

coupling the first and second mounting brackets to the preexisting recessed light fixture housing, the first mounting bracket adjacent one of the end walls, the second mounting bracket adjacent the other of the end walls;

provisionally coupling the ballast to the upper base panel of the preexisting recessed light fixture housing by pressing an adhesive on a mounting side of the ballast against the upper base panel of the preexisting recessed light fixture housing;

permanently mounting the provisionally coupled ballast to the preexisting recessed light fixture housing by manipulating at least one captive hardware element of the ballast relative to the housing, each captive hardware element being pre-installed in the ballast and designed to be movable relative to the ballast only upon application of deliberate force with respect to the captive hardware element; and closing an electric circuit, which includes the ballast and each electrical socket by electrically coupling a connector from the ballast to a power source associated with the ballast.

11. The method of claim 10, wherein the adhesive comprises a double-sided tape.

12. The method of claim 10, wherein the first mounting bracket comprises at least one additional captive hardware element, which is pre-installed in the mounting bracket and designed to be movable relative to the mounting bracket only upon application of deliberate force with respect to the additional captive hardware element, the step of coupling the first mounting bracket to the housing comprising the step of manipulating the additional captive hardware element relative to the housing.

13. The method of claim 10, wherein the step of electrically coupling the connector from the ballast to the power source comprises the step of mating together a quick connector that is pre-wired in the ballast to a quick connector of the power source.

14. The method of claim 10, wherein the captive hardware element comprises a self-drilling screw.

15. A kit for retrofitting a preexisting recessed light fixture housing mounted in a ceiling plane, the preexisting recessed light fixture housing having an upper base panel, a first end wall, and a second end wall opposite the first end wall, the first end wall and the second end wall extending generally downward from the upper base panel, the kit comprising:

a first mounting bracket configured to be coupled to the first end wall of the preexisting recessed light fixture housing and comprising a first electrical socket;

a second mounting bracket configured to be coupled to the second end wall of the housing and comprising a second electrical socket, the first and second electrical sockets completing a circuit with a lamp when the lamp is installed between the first and second electrical sockets;

a reflector panel configured to be attached to the first mounting bracket and to the second mounting bracket;

a ballast that provides power to the circuit when the retrofit kit assembly is installed in the recessed light fixture and configured to be coupled to the upper base panel of the preexisting recessed light fixture housing between the upper base panel and the reflector panel; and an adhesive disposed on a mounting side of the ballast to provisionally mount the ballast to the upper base panel of the housing prior to installation of a fastener, which permanently mounts the ballast to the upper base panel of the housing.

16. The kit of claim 15, wherein each of the first and second mounting brackets comprises at least one curved side reflector guide configured to control a shape of a reflector panel and wherein the kit further comprises a reflector panel.

17. The kit of claim 15, further comprising:

at least one first lens end cap coupled to the first mounting bracket;

at least one second lens end cap coupled to the second mounting bracket; and a diffuser lens held in place by the at least two lens end caps and the mounting bracket.

18. The kit of claim 15, wherein each mounting bracket comprises captive hardware, which is pre-installed in the mounting bracket and designed to be movable relative to the mounting bracket only upon application of deliberate force with respect to the captive hardware, the captive hardware configured to couple the mounting bracket to the housing.

19. The kit of claim 15, wherein the ballast and sockets are pre-wired with at least one connector, which mates with another connector to complete the circuit.

20. The kit of claim 15, wherein the fastener, which permanently mounts the ballast to the upper base panel of the housing comprises captive hardware, which is pre-installed in the ballast and designed to be movable relative to the ballast only upon application of deliberate force with respect to the captive hardware.

* * * * *